US005873203A

United States Patent [19]

Thiel

[11] Patent Number: 5,873,203

[45] Date of Patent: Feb. 23, 1999

[54] PHOTOELECTROLYTICALLY-DESICCATING MULTIPLE-GLAZED WINDOW UNITS

[75] Inventor: James P. Thiel, Pittsburgh, Pa.

[73] Assignee: PPG Industries, Inc., Pittsburgh, Pa.

[21] Appl. No.: 927,130

[22] Filed: Sep. 2, 1997

[51] Int. Cl.[6] ..... E04C 2/34

[52] U.S. Cl. ..... 52/172; 52/786.13; 428/34

[58] Field of Search ..... 52/171.3, 172, 52/204.593, 204.595, 786.1, 786.13, 788.1, 786.11; 428/34; 156/109

[56] References Cited

U.S. PATENT DOCUMENTS

| | | | |
|---|---|---|---|
| 2,838,809 | 7/1958 | Zeolla et al. . | |
| 3,771,276 | 11/1973 | Stewart et al. . | |
| 3,919,023 | 11/1975 | Bowser et al. . | |
| 4,000,593 | 1/1977 | Cypher | 52/172.1 |
| 4,109,431 | 8/1978 | Mazzoni et al. | 52/172.2 |
| 4,132,539 | 1/1979 | Jeffries . | |
| 4,140,591 | 2/1979 | Fong et al. | 204/38 R |
| 4,437,954 | 3/1984 | Sammells | 204/129 |
| 4,466,869 | 8/1984 | Ayers | 204/157.1 R |
| 4,622,249 | 11/1986 | Bowser . | |
| 4,952,430 | 8/1990 | Bowser et al. . | |
| 5,503,884 | 4/1996 | Meyer | 428/34 |
| 5,675,944 | 10/1997 | Kerr | 52/172.1 |

FOREIGN PATENT DOCUMENTS 0 475 213 3/1992 European Pat. Off. .

OTHER PUBLICATIONS

Hara, Michikazu et al. ; "$CU_2O$ as a photocatalyst for overall water splitting under visible light irradiation"; *Chem. Commun.,* 1998, pp. 357–358.

*Primary Examiner*—Carl D. Friedman
*Assistant Examiner*—Beth Aubrey
*Attorney, Agent, or Firm*—Donald C. Lepiane

[57] ABSTRACT

A multiple-glazed window unit of the type which includes two or more sheets maintained in spaced relationship to each other by a spacing assembly to form an airspace wherein surfaces of the unit in contact with the airspace are subject to the accumulation thereon of moisture and/or organic contaminants present in the airspace is rendered self-desiccating of accumulated moisture and/or self-cleaning of accumulated organic surface contaminants by coating such surfaces with a photoelectrolytically-desiccating coating and/or a photocatalytically-activated self-cleaning coating. Upon exposing the coatings to actinic radiation, at least a portion of the accumulated moisture is removed by photoelectrolysis and/or at least a portion of the organic contaminants are removed by photocatalytic decomposition. A desiccant may or may not be associated with the airspace to assist in maintaining a moisture-free airspace. Exterior surfaces of the unit may also be rendered self-cleaning of accumulated organic surface contaminants by coating such exterior surfaces with a photocatalytically-activated self-cleaning coating.

28 Claims, 1 Drawing Sheet

PHOTOELECTROLYTICALLY-DESICCATING MULTIPLE-GLAZED WINDOW UNITS

BACKGROUND

1. Field of the Invention

The present invention relates to multiple-glazed window units of the type having a pair of sheets separated by a spacing assembly to define an airspace and, more particularly, to multiple-glazed window units having a photoelectrolytically-desiccating coating over one or more surfaces contacting the airspace. The photoelectrolytically-desiccating coating desiccates the airspace by promoting the photoelectrolysis of moisture present in the airspace and accumulated over the photoelectrolytically-activated coating into hydrogen gas and oxygen gas when the photoelectrolytically-desiccating coating is exposed to actinic radiation.

2. Description of the Related Art

Multiple-glazed window units include two or more sheets, also known as panes, of glass, plastic, metal, wood or combinations thereof spaced from each other by a spacing assembly to define a space between the sheets. Several different embodiments of multiple-glazed window units are known, and an overview of many of the embodiments are discussed in European Patent Application Publication No. 0,475,213 A1 published Mar. 18, 1992 (hereinafter "The EP Application") which is hereby incorporated herein by reference.

The airspace of the multiple-glazed window units may be sealed from the atmosphere external of the airspace (hereinafter "sealed units") or it may be in fluid communication with the atmosphere external to the unit (hereinafter "breathing units"). The term sealed units as used herein includes but is not limited to units forming a perfect or nearly perfect hermetic seal between the sheets, e.g. welded edge units as disclosed in U.S. Pat. No. 4,132,539 to Jeffries and discussed in more detail below, and units of the type employing a spacer assembly of the type which includes a spacer and an adhesive/sealant interposed between the sheets and the spacer to adhere the sheets to the spacer to form a "sealed" airspace e.g. of the type disclosed in U.S. Pat. No. 3,919,023 to Bowser et al., and U.S. Pat. No. 4,622,249 to Bowser, also discussed in more detail below. Although the latter will be referred to hereinafter as "sealed" units, as may be appreciated, such units employing an adhesive/sealant are not completely "sealed" from the external atmosphere because the adhesive/sealant used in the manufacture of such "sealed" units is not truly moisture impervious and cannot form a complete water vapor barrier. Such units permit at least a limited ingress/egress of water vapor and other gases through the adhesive/sealant and into or out of the airspace. As used hereinafter, the term "sealed" unit includes units employing a spacer and adhesive/sealant which units exhibit a water vapor permeability of less than about 20 grams/day/square meter/millimeter of mercury (hereinafter "Hg") at about 100° F., 90% relative humidity as determined by the Standard Methods of Testing For Water Vapor Transmission of Materials in Sheet Form, ASTM Designation E-96-66, Method E. Conversely, as used hereinafter the term "breathing" units includes units of the type employing a spacer and adhesive/sealant, but which units further include one or more devices in addition to the water vapor permeability of the adhesive/sealant to provide fluid communication between the airspace and the atmosphere external of the unit. The term "breathing" unit also includes units having no such additional devices but which exhibit a water vapor permeability of greater than about 20 grams/day/square meter/millimeter of Hg, at about 100° F., 90% relative humidity as determined by the Standard Methods of Testing For Water Vapor Transmission of Materials in Sheet Form, ASTM Designation E-96-66, Method E.

It is desirable to keep the airspace and surfaces of multiple-glazed insulated window units in contact with the airspace (hereinafter "the interior surfaces") dry, e.g. free of accumulated water or water vapor. It is also desirable to keep the airspace and interior surfaces clean e.g. free of surface contaminants. Moisture accumulated in the airspace and on the interior surfaces, particularly on glass interior surfaces, may cause fogging and may absorb or leach molecules or ions from the surfaces resulting in the formation of an undesirable scum or stain on the interior surfaces of the unit. Accumulated surface contaminants on the interior surfaces are visually unappealing.

While it is desirable to keep the airspace and interior surfaces clean and dry, it is difficult to do so because moisture and surface contaminants can accumulate in the airspace and on the interior surfaces from several sources. These sources include: entrapment within the airspace and on the interior surfaces during manufacture of the unit and/or entry into the airspace through the adhesive/sealant of units employing such an adhesive/sealant. In addition, breathing units have an additional susceptibility to the accumulation of moisture and surface contaminants within the airspace in that moisture and/or surface contaminants can enter the airspace as the atmosphere external of the unit passes into and out of the airspace.

Efforts have been made to minimize if not eliminate the accumulation of moisture in the airspace and on the interior surfaces of a multiple-glazed window unit. Some of these efforts rely upon a desiccant, and some do not.

For example, a presently available sealed unit of the type referred to as a "glass on glass" or "welded edge" unit referred to above prevents moisture accumulation in the airspace by welding edges of glass sheets to each other, and filling the airspace between the welded sheets with a dry, insulating gas. Such a unit typically does not include a desiccant. One example of such a unit is disclosed in U.S. Pat. No. 4,132,539 to Jeffries, which is hereby incorporated herein by reference.

Another presently available sealed unit interposes a spacing assembly of the type which includes a hollow spacer and an adhesive/sealant between the spacer and the sheets to provide a sealed airspace between the sheets. Such a unit includes a desiccant to absorb moisture from the airspace. Examples of such units are disclosed in U.S. Pat. No. 3,919,023 to Bowser et al., and U.S. Pat. No. 4,622,249 to Bowser, which are hereby incorporated herein by reference.

A presently available breathing unit prevents or minimizes moisture from accumulating in the airspace by associating a desiccant column with the air flowing into and out of the airspace. Such units are described in U.S. Pat. No. 2,838,809 to Zeolla et al., and U.S. Pat. No. 3,771,276 to Stewart et al.

Another presently available breathing unit prevents moisture accumulation in the airspace without requiring the use of a desiccant by including a plurality of openings in the spacing assembly to put the airspace in communication with the atmosphere external to the unit, which openings are sized and configured to allow a controlled movement of atmospheric air and moisture through the airspace. The unit equalizes the airspace pressure and relative humidity with that of the external atmosphere to prevent moisture from collecting in the airspace, yet still provides an insulating airspace. Such a unit is described in U.S. Pat. No. 4,952,430 to Bowser et al., which is hereby incorporated herein by reference.

Each of the presently available multiple-glazed window units has limitations. Insulated units having edges of the glass sheets welded together require specialized equipment to heat and fuse the edges of the sheets together. Sealed and breathing units employing a spacing assembly of the type including a spacer and adhesive/sealant are subject to ingress and egress of moisture through the adhesive/sealant, and many such units rely upon a desiccant associated with the airspace in an amount sufficient to absorb an expected rate of moisture ingress into the airspace through the adhesive/sealant over the expected life of the unit. This introduces a finite useful life for such a unit because the infiltration of relatively moist exterior air into the airspace ultimately causes saturation and exhaustion of the desiccant associated therewith. Further, surface contaminants accumulated on the interior surfaces of the presently available units can only be removed only by the complete disassembly of the unit in order to subject the interior surfaces to a cleaning operation, followed by complete reassembly of the unit.

All of the above-discussed presently available multiple-glazed window units are acceptable in one or more applications; however, as can now be appreciated, not every unit is ideally suitable for every use. It would be advantageous therefore to provide a multiple-glazed window unit having features which make the unit less expensive to manufacture than the presently available units while eliminating the limitations of the presently available units.

SUMMARY OF THE INVENTION

One embodiment of the present invention includes a multiple-glazed window unit of the type having two or more sheets, e.g. glass panes, maintained in spaced relationship to each other by a spacing assembly to form an airspace therebetween, to form a sealed or breathing multiple-glazed window unit. The improvement of the present invention includes providing a photoelectrolytically-desiccating coating (hereinafter "PED" coating) over at least a portion of at least one of the interior surfaces of the unit, which coating functions to desiccate the airspace by promoting the photoelectrolysis of moisture present in the airspace and accumulated over the interior surfaces into hydrogen and oxygen gas when the coating is exposed to actinic radiation.

In an alternative embodiment of the present invention, the PED coating may be overcoated or undercoated with a hydrophilic coating which hydrophilic coating functions to draw moisture from the airspace to the PED coating to increase the contact between moisture present in the airspace and the PED coating in order to increase the rate and efficiency of the photoelectrolysis process.

In an alternative embodiment, the multiple-glazed window unit of the present invention may include a photocatalytically-activated self-cleaning coating (hereinafter "PASC" coating) over at least a portion of at least one of the interior surfaces of the unit, which PASC coating functions to provide photocatalytic self-cleaning of organic contaminants present over the PASC coating within the airspace. The PASC coating may be separate from, in lieu of, or a component of the PED coating in which a single coating over at least a portion of the interior surfaces of the unit may provide both photoelectrolytic desiccation and photocatalytic self-cleaning.

In yet another embodiment of the present invention, a multiple-glazed window unit is provided having at least a portion of the interior surfaces coated with a PED coating, PASC coating or both and having at least a portion of the surfaces not in contact with the airspace (hereinafter "the exterior surfaces") coated with a PASC coating, to remove any organic contaminants which may have accumulated on the exterior surfaces of the unit.

In yet another embodiment of the present invention, the multiple-glazed window unit of the present invention may optionally include in addition to the foregoing, a desiccant in contact with the airspace, which desiccant functions to absorb moisture from the airspace and to assist the PED coating in providing a moisture-free airspace.

DESCRIPTION OF THE PREFERRED EMBODIMENTS

Figure 1:
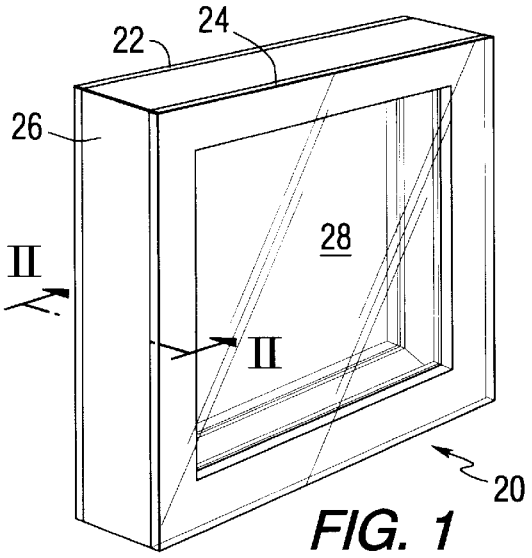
FIG. 1 is a perspective view of a multiple-glazed window unit illustrating the basic components of the unit.

In the following discussion like numerals refer to like elements, and the multiple-glazed window units are described as having two sheets; however, as is appreciated by those skilled in the art, multiple-glazed window units with more than two sheets are also contemplated. Further, as used herein, the term "multiple-glazed window unit" includes spandrel units in which one or more of the sheets are rendered opaque by a suitable opacifier, e.g. such as taught in U.S. Pat. No. 4,000,593 to Cypher, which is also hereby incorporated herein by reference. In addition, the present invention may be practiced where any two panes are separated by an airspace, thereby including units which are not commonly referred to as "multiple-glazed window units", such as a single pane glass window separated from a storm window to provide an airspace therebetween.

Further, while the space between the sheets is referred by its common term hereinafter as an "airspace" for the sake of simplicity, in the following discussion and as may be appreciated by those skilled in the art, in addition to or in lieu of air, the "airspace" may contain other substances such as an insulating gas, e.g. argon or krypton, and/or mixtures thereof, and/or it may constitute a full or partial vacuum.

In the following discussion the instant invention is disclosed by discussing different designs of multiple-glazed window units incorporating features of the invention. However, as will be appreciated, the invention is disclosed in this manner for a better appreciation of the invention but is not limiting to the invention. For example, the design features of one unit may be used with the design features of another unit.

Virtually all types of multiple-glazed window units are compatible with the present invention. Included are multiple-glazed window units having two or more sheets or panes, which may be generally divided into the sealed and unsealed (breathing) units described above, either of which may or may not employ a desiccant material. Several of such units are described in the EP application, incorporated herein above. More particularly, an example of a sealed unit which does not typically include a desiccant is the welded edge unit described in U.S. Pat. No. 4,132,539 while examples of sealed units which do employ a desiccant include the units described in U.S. Pat. Nos. 5,177,916; 5,255,481; 5,531,047; 5,601,677; 5,553,440; 5,617,699; 4,622,249 and 3,919,023. An example of a breathing unit which does not include a desiccant is that as described in U.S. Pat. No. 4,952,430 while examples of breathing units which do employ a desiccant are disclosed in U.S. Pat. Nos. 2,838,809 and 3,771,276. All of the foregoing are incorporated herein by reference.

The spacing assemblies of the insulated window units that may be used in the practice of the present invention are not limiting to the invention, and may be made of any material and configuration that provides structural stability to maintain the sheets in spaced relationship to one another when the usual biasing forces are applied to the unit, such as when the unit is placed in a sash or a curtainwall system. It is preferred that the spacing assembly have low thermal conductivity. Suitable spacing assemblies include spacing assemblies employing a spacer formed primarily of an organic component, e.g. a polymeric matrix, which may or may not include a desiccant material embedded in the polymeric matrix. Suitable spacing assemblies also include those having spacers which are of a generally square, rectangular or u-shaped cross-section, each of which may include a hollow interior or channel, e.g. as disclosed in U.S. Pat. Nos. 2,306,327; 2,838,810; 2,684,266; 3,280,523; 3,919,023; 5,177,916; 5,255,481; 5,531,047; 5,601,677; 5,553,440; 5,617,699; 4,952,430 and 4,622,249 which teachings are all herein incorporated by reference. Where the spacer includes a hollow interior or channel, and the unit employs a desiccant material, the desiccant may be retained in contact with the airspace within the hollow or channel of the spacer.

In regards to the spacing assembly having a low thermal conductivity, spacers made of aluminum conduct heat better than spacers made of metal coated steels, e.g. galvanized or tin plated steel, spacers made of metal coated steels conduct heat better than spacers made of plastics. Plastic provides a better spacer from the standpoint of low thermal conductivity, however, metal is preferred for spacers because it is easier to shape and lends itself more easily to automation than plastic.

Further, the insulating units of the present invention may include one or more functional sheets and/or sheets having functional coatings on one or more of the major surfaces thereof. The functional sheets or functional coatings may exhibit optical, thermal, safety, aesthetic, solar control properties or mixtures thereof. For example, either or both of the sheets may be laminated, heat strengthened, or tempered for safety or other purposes. Either or both of the sheets may include functional coatings which include but are not limited to: antireflective coatings, antiglare coatings, antifogging coatings, coatings with deicing and/or defrosting abilities in the presence of an applied electrical current, ultraviolet filtering coatings, emissivity filtering coatings, tinting, coloring and/or shading coatings. The functional coating(s) may be present on the interior or exterior surfaces of the sheets or other interior and/or exterior surfaces of the multiple-glazed window unit.

Referring now to FIG. 1, there is shown the basic components of a multiple-glazed window unit 20. The basic components of the window unit 20 include a pair of panes or sheets 22, 24 maintained in spaced relation to each other by a spacing assembly 26 defining an insulating airspace 28 between the sheets 22, 24. Where unit 20 is a breathing type unit, it may include one or more openings, also known as breathing holes, (not shown) provided through the spacing assembly 26 to provide direct communication of the airspace 28 with the external atmosphere surrounding the window unit 20, for example, as shown in U.S. Pat. Nos. 4,952,430; 3,771,276 and 2,838,809.

Multiple-Glazed Unit Design No. 1—PED Unit

Figure 2:
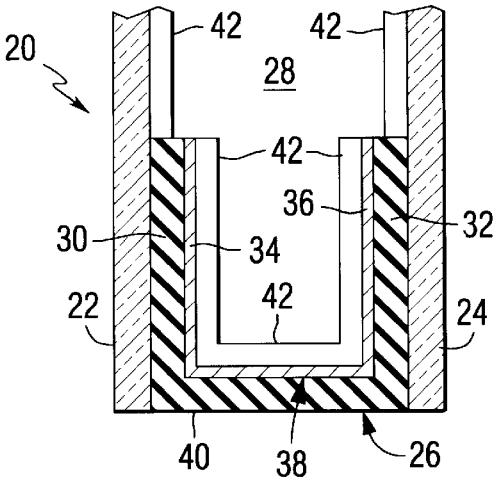
FIG. 2 is a fragmentary cross-sectional view of a sealed window unit of the present invention taken along the line II—II in FIG. 1 illustrating PED coatings over selected interior surfaces of the unit.

Shown in FIG. 2 is sealed unit 20 which includes PED coatings in contact with the airspace in accordance with the present invention. Unit 20 includes spacing assembly 26 to space sheets 22 and 24. The spacing assembly 26 includes adhesive/sealant layers 30 and 32 to adhere sheets 22 and 24 respectively to outer legs 34 and 36 of metal spacer 38 to provide airspace 28 between the sheets. Subject to the above discussed unavoidable permeability, adhesive/sealant layers 30 and 32 act as a barrier to moisture entering the airspace 28. With respect to the loss of a fill gas from the unit, e.g. insulating gas such as argon, in practice the length of the diffusion path and thickness of the adhesive/sealants 30 and 32 are chosen in combination with the gas permeability of the adhesive/sealant material so that the rate of loss of the fill gas matches the desired unit performance lifetime. Preferably, for sealed unit containing a fill gas in airspace 28, the rate of loss of the fill gas should be less than 5% per year and more preferably it should be less than 1% per year.

An additional sealant/adhesive 40 may be provided in perimeter groove of the unit formed by the spacer and marginal edges of sheets 22 and 24. As can be appreciated the adhesive/sealants 30, 32 and 40 are not limiting to the invention and may be any types known in the art, e.g. of the type taught in U.S. Pat. No. 4,109,431 which teachings are hereby incorporated by reference. A preferred sealant/adhesive is a polyisobutylene adhesive/sealant.

Referring still further to FIG. 2, there is shown a PED coating 42 provided in any convenient manner over the interior surfaces of airspace 28, e.g. interior surfaces of sheets 22, 24 and spacing assembly 26. The PED coating 42 operates to remove moisture from the airspace 28 by promoting the photoelectrolysis of water or water vapor present in the airspace 28 and accumulated over the PED coating into its constituent components, namely primarily hydrogen and oxygen gas. It is believed that the gaseous by-products of the photoelectrolytic desiccation process exit airspace 28 via the same route by which moisture entered airspace 28, e.g. by diffusing through adhesive/sealants 30 and 32.

While PED coating 42 is shown over several interior surfaces in FIG. 2, as may be appreciated, in accordance with the present invention it is necessary only that the PED coating 42 be present over at least a portion of at least one of interior surfaces of unit 20, provided sufficient PED coating is present to maintain a desired or required rate of photoelectrolytic desiccation within airspace 28. More particularly, as may be appreciated, it is within the scope of the present invention to include the PED coating 42 over only one of sheets 22, 24 and/or spacing assembly 26 or to include the PED coating 42 over a combination of all or less than all of the interior surfaces of unit 20. In a preferred embodiment, PED coating 42 is formed over the entire interior surfaces of sheets 22 and 24 and spacing assembly 26 to maximize the photoelectrolytically-desiccating effect. For most applications, the PED coating 42 is preferred to be present over at least about 5 to about 100% of the total surface area of the interior surfaces of unit 20 to effectively remove moisture vapor from airspace 28.

Multiple-Glazed Unit Design No. 2—PED/Hydrophilic Unit

Figure 3:
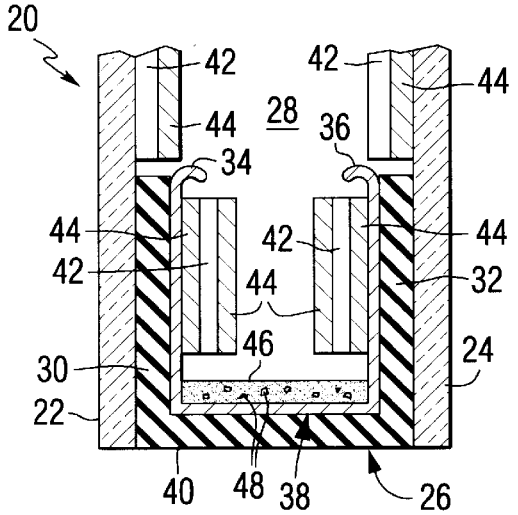
FIG. 3 is a fragmentary cross-sectional view similar to FIG. 2 of an alternative embodiment of the present invention illustrating hydrophilic coatings associated with PED coatings over selected interior surfaces of the unit and the use of an optional desiccant.

Referring now to FIG. 3 there is shown an alternative embodiment of the present invention in which unit 20 includes an optional hydrophilic coating 44 associated with PED coating 42. Hydrophilic coating 44 functions to draw moisture from the airspace 28 to the PED coating 42 to increase the contact between moisture present in the airspace 28 and the PED coating 42 in order to increase the rate and efficiency of the photoelectrolytic desiccation process.

The PED coating 42 may be deposited directly over an interior surface of airspace 28 and then overcoated with hydrophilic coating 44, e.g. as shown over sheet 22 in FIG. 3. Alternatively, the hydrophilic coating 44 may be deposited directly over an interior surface of airspace 28 and then overcoated with PED coating 42, e.g. as shown over sheet 24 in FIG. 3. In still another embodiment, the PED coating 42 may be interposed between hydrophilic coatings as shown over the interior surfaces of outer legs 34 and 36 of spacer 38 in FIG. 3.

Regarding the outer legs 34 and 36, an alternative embodiment is shown in FIG. 3 in which the ends of the outer legs 34 and 36 are radiused inwardly to provide stability to the spacer 38, e.g. to reduce flexing of the spacer 38.

Also shown in FIG. 3 is a thin layer or bead 46 of a moisture and/or gas pervious adhesive having a desiccant 48 therein to assist the PED coating 42 in removing moisture from the airspace by absorbing moisture not photoelectrolytically decomposed by the PED coating 42. The bead 46 is shown in the inner surface of the middle leg of spacer 38 as viewed in FIG. 3, although it is to be understood that neither the placement of the adhesive 46 within the airspace, nor the adhesive composition itself are limiting to the invention. The adhesive bead 46 may be any type that passes moisture and/or gas.

As may be appreciated the embodiments shown on the left and right sides of FIG. 3 are not mutually exclusive, and the features of each may be incorporated into the other. In other words, the alternative embodiments of the left and right sides of FIG. 3 have been incorporated into a single drawing only for the sake of brevity.

Multiple-Glazed Unit Design No. 3—PASC Unit

Figure 4:
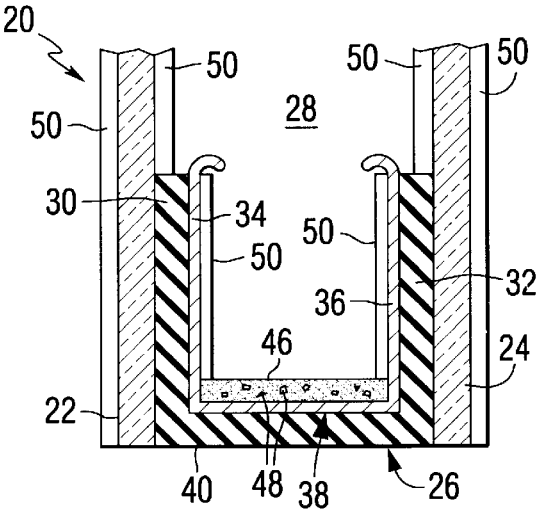
FIG. 4 is a fragmentary cross-sectional view similar to FIG. 2 of an alternative embodiment of the present invention illustrating PASC coatings over selected interior surfaces of the unit and the use of an optional desiccant.

Referring now to FIG. 4 there is shown an alternative embodiment of the present invention in which unit 20 includes a PASC coating 50 over the interior surfaces of the unit. The PASC coating 50 may be provided in any convenient manner and functions to provide photocatalytically-activated self-cleaning of organic contaminants accumulated over the PASC coating by decomposing such contaminants primarily into carbon dioxide and water vapor. It is believed that the gaseous by-products of the photocatalytically-activated self-cleaning process exit airspace 28 via the same route by which moisture entered airspace 28, e.g. by diffusing through adhesive/sealant 30 and 32.

As may be appreciated, it is within the scope of the present invention to include the PASC coating 50 over only one of the interior surfaces of sheets 22, 24 and spacing assembly 26 or to include the PASC coating 50 over a combination of all or less than all of the interior surfaces of unit 20. In a preferred embodiment, PASC coating 50 is formed over the entire interior surfaces of sheets 22 and 24 to prevent the visually unappealing accumulation of surface contaminants over the interior surfaces of sheets 22 and 24. In an alternative embodiment, the PASC coating 50 may be formed over only a portion of the interior surfaces of sheets 22, 24 and/or spacing assembly 26, where photocatalytically-activated self-cleaning is desired or required.

In an alternative embodiment of the invention, PASC coatings are provided over at least a portion of at least one of the exterior surfaces of the unit 20 to provide photocatalytic self-cleaning of accumulated organic contaminants present over the external surfaces. Shown in FIG. 4 are optional PASC coatings 50 disposed over the exterior surfaces of sheets 22 and 24.

Multiple-Glazed Unit Design No. 4

Figure 5:
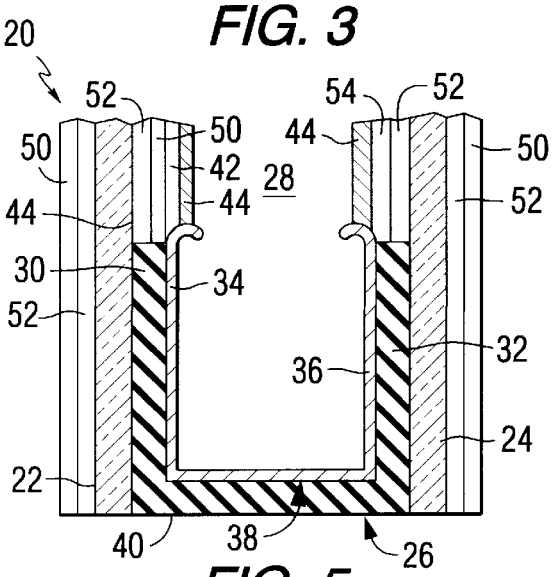
FIG. 5 is a fragmentary cross-sectional view similar to FIG. 2 of an alternative embodiment of the present invention illustrating a combination of PED coatings, hydrophilic coatings, PASC coatings, combined PED/PASC coatings and sodium ion diffusion barrier layers (hereinafter "SIDB" layers) over selected interior surfaces of the unit and PASC coatings and SIDB layers over external surfaces of the unit.

FIG. 5 illustrates a combination of SIDB layers, PASC coatings, PED coatings, PASC/PED coatings and hydrophilic coatings.

As shown over the interior surface of sheet 22 in FIG. 5, an SIDB layer 52 may be interposed between PASC coating 50 and/or PED coating 42 and its supporting substrate (e.g. sheet 22) to prevent ion migration, and sodium ion migration in particular, from the substrate into the PASC and/or PED coating deposited thereover. Many substrates, particularly glass substrates, include sodium ions which can migrate from such substrates into coatings deposited over such substrates. When sodium ions migrate into the PED coatings and/or PASC coatings, the photoelectrolytically desiccating and/or photocatalytic self-cleaning activity of the such coatings may be reduced if not eliminated. This process is commonly referred to as sodium poisoning or sodium ion poisoning. Sodium ion poisoning may be prevented by: making the PED coating and/or PASC coating sufficiently thick so as to absorb the sodium ions within only a portion of the coating, thereby permitting the remainder of the coating to remain photoelectrolytically or photocatalytically active; or by interposing an SIDB layer between the PED and/or PASC coating and the substrate. Where all or a portion of the interior surfaces of unit 20 include sodium ions, e.g. where sheets 22, 24 are formed from soda-lime-lime silica glass, SIDB layer 52 functions to prevent the migration of sodium ions from sheets 22, 24 into the PED coating 42 and/or PASC coating 50 disposed thereover, in turn preventing sodium ion poisoning. U.S. Provisional Patent Application Ser. No. 60/040,566 filed Mar. 14, 1997, and U.S. Regular patent application Ser. No. 08/899,265 filed Jul. 23, 1997, in the name of Charles S. Greenberg et al., entitled "Photocatalytically-Activated Self-Cleaning Article And Method Of Making Same", hereby incorporated herein by reference, contain a detailed discussion of reducing or eliminating sodium ion poisoning of PASC coatings, including the use of the tin side of glass substrates produced by the float ribbon process as an SIDB layer. SIDB layer 52 is also shown in FIG. 5 interposed between the external surfaces of sheets 22 and 24 and PASC coatings 50 disposed thereover. As may be appreciated, the use of an SIDB layer is not limited to the prevention of sodium ion poisoning of the PED coating and/or PASC coating, but may be used to prevent ion poisoning of other layers/coatings present which are subject to such poisoning.

FIG. 5 also illustrates the combination of a PASC coating 50 with a PED coating 42 and a hydrophilic coating 44, as shown over the interior surface of sheet 22. While the combination is shown for illustrative purposes, as may be appreciated, additional functional layers or coatings may be included and the relative positions of one or more of the SIDB coating 52, PASC coating 50, PED coating 42 and hydrophilic coating 44 may be changed and such coatings may be removed or additional such coatings included to provide several additional combinations. The combinations are limited only in that where an SIDB layer is present, it must be interposed between any PED coatings and/or PASC coatings present and the source of the sodium ions (e.g. a substrate or another film or coating) to prevent sodium ion poisoning of the PED coating and/or PASC coating; that sufficient actinic radiation must pass through the coating stack to any PED coating and/or PASC coating present so as to induce a desired or required rate of photocatalytically-activated self cleaning or photoelectrolytic-desiccation; and that the photocatalytically activated self-cleaning process or photoelectrolytic-desiccation process must be able to operate through any coatings or layers interposed between the PASC coatings and/or PED coatings and organic contaminants or moisture sought to be removed by the respective processes.

An alternative combination is shown over the interior surface of sheet 24, in which an SIDB layer 52 is interposed between sheet 24 and combined PASC/PED coating 54, which is in turn overcoated with hydrophilic layer 44. The combined PASC/PED coating 54 is a single coating that provides both photocatalytically-activated self-cleaning and photoelectrolytic-desiccation. The PASC/PED coating 54 may be a heterogeneous coating comprised of PASC and PED elements, or it may be a homogeneous coating exhibiting both PASC and PED properties.

As may be appreciated, the combinations of SIDB layers, PASC coatings, PED coatings and hydrophilic coatings discussed above, some of which are illustrated over the interior surfaces of sheets 22 and 24 are not limited to those interior surfaces, but may be deposited in any convenient manner over any of the interior surfaces of unit 20.

One advantage of the unit 20 shown in FIG. 5 is that it provides moisture-free airspace 28 without the use of limited lifetime desiccants, although, as may be appreciated, a desiccant could be included if desired. Removing the desiccant has an additional benefit of reducing the strain on a sealed unit. Moisture or other absorbable materials present in the air or gas inside a sealed unit are adsorbed into a desiccant when the unit is relatively cool, but at least a portion may evaporate or outgas from the desiccant when the unit is heated e.g. by sunlight. Outgassing produces pressure within the airspace. Conversely, when cool, the adsorbed moisture may cause the airspace to experience a limited vacuum/contraction effect. The rate of this contraction expansion or pressure/vacuum cycle increases with increasing pore size of the desiccant because the rate of absorption and/or outgassing is facilitated by the larger pore size (e.g. greater than about 4 Angstroms) of the desiccant, and produces strain on the unit. Eliminating desiccant from the sealed airspace eliminates the strain associated with such desiccants. Another advantage of the unit 20 as shown in FIG. 5 is that where the PASC coatings and PED coatings are deposited over the interior surfaces of unit 20, such coatings may be positioned over or near sealant/adhesives 30 and 32, to provide photoelectrolytic-desiccation and/or photocatalytically-activated self cleaning of moisture and/or contaminants leaching through sealant/adhesives 30 and 32 as they enter or exit airspace 28.

As may be appreciated, the embodiments shown on the left and right sides of FIG. 5 are not mutually exclusive, and the features of each may be incorporated into the other. In other words, the alternative embodiments of the left and right sides of FIG. 5 have been incorporated into a single drawing only for the sake of brevity.

Figure 6:
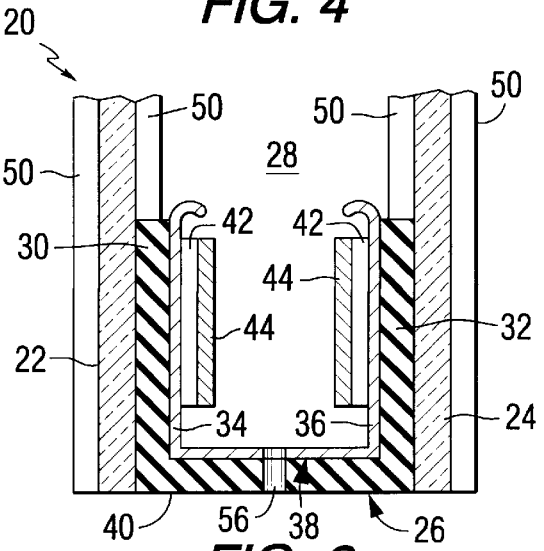
FIG. 6 is a fragmentary cross-sectional view similar to FIG. 2 of an alternative embodiment of the present invention illustrating a combination of PED coatings, hydrophilic coatings and PASC coatings over selected interior and exterior surfaces of a breathing type unit.

Multiple-Glazed Unit Design No. 5—Combined PED and PASC Breathing Desiccant-Free Unit Referring now to FIG. 6 an alternative embodiment of the present invention illustrating a breathing type unit 20 is shown having opening 56, also known as breather hole, through spacer 38 and adhesive/sealant 40 to place airspace 28 in fluid communication with the atmosphere external of the unit 20. While only one opening 56 is shown in FIG. 6, as may be appreciated, unit 20 may include a plurality of openings 56. Unit 20 as shown in FIG. 6 includes PED coating 42 deposited over the interior surfaces of outer legs 34 and 36 of spacer 38, in turn having hydrophilic coating 44 deposited thereover. Unit 20 as shown in FIG. 6 further includes PASC coating 50 deposited over the interior and exterior surfaces of sheets 22 and 24.

The embodiment shown in FIG. 6 has the advantage that as air from the external atmosphere enters airspace 28 through opening 56, it passes over hydrophilic coating 44 and PED coating 42 and moisture is photoelectrolytically removed from the airstream upon entry into the interior of unit 20. The unit 20 of FIG. 6 also has an advantage in that when the PED coatings and hydrophilic coatings are included within spacer 38, as opposed to being included over the sheets 22 and 24, the coatings may be as thick as required or desired without interfering with the aesthetics of the unit 20.

The embodiment shown in FIG. 6 also has the advantage that PASC coating 50, deposited over the entire interior surfaces of sheets 22 and 24, operates to keep the interior surfaces of the sheets free from the accumulation of organic contaminants in turn ensuring that the entire viewing area of the sheets 22 and 24 remain visually appealing. The foregoing is also true of the exterior surfaces of sheets 22 and 24. The volatile byproducts of the PED and/or PASC processes occurring within airspace 28 are believed to exit airspace 28 through opening 56.

The breathing unit 20 as shown in FIG. 6 remains clean and moisture-free without the use of a limited lifetime desiccant, although, as may be appreciated, a desiccant may be associated with the airspace 28 if desired.

As may be appreciated, where the multiple-glazed window unit is a breathing type unit, there exists a higher probability that moisture and/or surface contaminants may migrate from the external atmosphere into the airspace and accumulate therein. Such breathing units may require thicker and/or more reactive PED coatings and/or PASC coatings on the interior surfaces of the unit. Further, the flow of air through the breathing unit may cause moisture and/or surface contaminants to accumulate over a particular portion or portion of the interior surfaces of the unit, requiring a thicker or more reactive PED coating and/or PASC coating over those portions. Conversely, sealed units are expected to have a much lower permeability for surface contaminants and water vapor, and the PED coatings and/or PASC coatings may be thinner, less reactive or disposed over fewer or smaller areas of the interior surfaces of the unit than would be required for a breathing type unit.

In each of the multiple-glazed window unit designs described above, it is to be noted that the functions of the PED coatings and PASC coatings when both are present in unit 20 are complementary to the other, in that as the PASC coating decomposes organic surface contaminants to carbon dioxide and water vapor, the PED coatings in turn function to photoelectrolytically-desiccate the water vapor into hydrogen and oxygen gas, thereby removing both surface contaminants and moisture from airspace 28 of the unit 20.

PED coatings compatible with the present invention include photoelectrolytically-desiccating oxides in general, and more particularly may be selected from, but not limited to, titanium oxides, iron oxides, silver oxides, copper oxides, tungsten oxides, aluminum oxides, silicon oxides, zinc stannates, molybdenum oxides, zinc oxides, strontium titanate and mixtures thereof. As can be appreciated by those skilled in the art, the metal oxide may include oxides or suboxides of the metal.

A preferred PED coating is titanium dioxide. Titanium dioxide exists in an amorphous form and three crystalline forms, the anatase, rutile and brookite forms respectively. Titanium oxides, particularly anatase phase titanium dioxide, is preferred because it exhibits the strongest PED activity, i.e. it exhibits a suitable band gap (i.e. about 360 nm) necessary for photoelectrolytic-desiccation and has excellent chemical and physical durability. Further, it is transmitting in the visible region of the spectrum making it useful for use on a transparency. The rutile form also exhibits PED activity. Combinations of the anatase and/or rutile phase with the brookite and/or amorphous phases are acceptable for the present invention provided the combination exhibits PED activity. An anatase titanium dioxide film of about half-wave thickness, e.g. about 110 nanometers provides a sufficiently photoelectrolytically-desiccating coating for many multiple-glazed window units.

Hydrophilic coatings compatible with the present invention are characterized by chemical durability and a low index of refraction, preferably near that of the substrate to provide an antireflective coating and by the ability to attract and direct moisture from the hydrophilic coating to the PED coating and to permit the by-products of the photoelectrolytic desiccation to migrate through the hydrophilic coating. Hydrophilic coatings compatible with the present invention include alumina, silica, silicates, aluminates, aluminosilicates and mixtures thereof. One measure of hydrophilicity of a coating is the contact angle of a sessile drop of water placed over the coating. The measurement of contact angles is well known in the art, and is the angle between the glass and the drop as the drop is viewed from the side on a flat surface. The lower the contact angle indicates a higher degree of hydrophilicity. Preferred hydrophilic coatings for the present invention have a contact angle of less than about 10 degrees and preferably less than about 5 degrees. It is preferred that the hydrophilic coating exhibit the ability to remove at least about 0.1 ml of water per year from the airspace under solar illumination.

A preferred hydrophilic coating is silicon dioxide, which is preferred because of its low cost, ease of application and ability to satisfy the above listed requirements. A silicon dioxide coating of quarter wave thickness, e.g. about 90 nanometers, provides a sufficiently hydrophilic coating for many multiple-glazed window units.

PASC coatings compatible with the present invention include photocatalytically-activated self-cleaning oxides in general, and more particularly may be selected from, but not limited to, titanium oxides, iron oxides, silver oxides, copper oxides, tungsten oxides, aluminum oxides, silicon oxides, zinc stannates, molybdenum oxides, zinc oxides, strontium titanate and mixtures thereof. As can be appreciated by those skilled in the art, the metal oxide may include oxides or suboxides of the metal.

A preferred PASC coating is titanium dioxide. Titanium oxides, particularly anatase phase titanium dioxide, is preferred because it exhibits the strongest PASC activity, i.e. it exhibits a suitable band gap (i.e. about 360 nm) necessary for photocatalytically-activated self-cleaning and has excellent chemical and physical durability and transmission in the visible region of the spectrum, as noted above. The rutile form also exhibits PASC activity. Combinations of the anatase and/or rutile phase with the brookite and/or amorphous phases are acceptable for the present invention provided the combination exhibits PASC activity.

SIDB layers compatible with the present invention include amorphous or crystalline metal oxides including metal oxides such as cobalt oxides, chromium oxides and iron oxides, tin oxides, silicon oxides, titanium oxides, zirconium oxides, fluorine-doped tin oxides, aluminum oxides, magnesium oxides, zinc oxides and mixtures thereof. Mixtures include but are not limited to magnesium/aluminum oxides and zinc/tin oxides. As may be appreciated by those skilled in the art, the metal oxide may include oxides or suboxides of the metal.

Aside from sodium ion poisoning considerations, the PED coating and/or PASC coating must be sufficiently thick so as to provide an acceptable level of PED and/or PASC activity respectively. There is no absolute value which renders a PED or PASC coating "acceptable" or "unacceptable" because whether a coating has an acceptable level of activity is determined by the conditions under which the multiple-glazed window unit will operate and the desired or required performance characteristics sought from the unit, which can vary as may be appreciated. In general, thicker coatings provide higher PED and/or PASC activity. However, other considerations may weigh toward providing a thinner coating such as increasing transparency of the article for aesthetic or optical reasons; where a limited amount of moisture expected to accumulate in the airspace 28; where the surface contaminants expected to gather on the surface of the article are easily removed, e.g. the more easily removed the thinner the PASC coating may be; the duration and intensity of actinic radiation expected to irradiate the PED and/or PASC coating e.g. where the article is expected to be exposed to much actinic radiation, the PED and/or PASC coating may be thinner and still provide sufficient PED and/or PASC activity. Still other factors, such as the nature of the substrate may affect PED and/or PASC coating thickness considerations e.g. the extent to which the substrate may subject the PED and/or PASC coating to sodium ion poisoning and/or whether an SIDB layer will be used to limit sodium ion poisoning. For a wide variety of applications, it is preferred that where separate PED coatings and PASC coatings are employed, each coating individually is at least about 200 Angstroms (hereinafter Å) preferably at least about 400 Å and more preferably at least about 500 Å thick to provide an acceptable level of photoelectrolytic-desiccation photocatalytic self-cleaning, respectively. Where a single combined PED/PASC coating is to provide both PED and PASC activity, it is preferred that the coating is at least about 200 Å, preferably at least about 400 Å and more preferably at least about 500 Å thick to provide an acceptable level of photoelectrolytic-desiccation and photocatalytic self-cleaning.

The ability or rate of a PED coating to perform the photoelectrolysis of moisture into hydrogen and oxygen may be reported in the units of micromoles of water desiccated per watts of applied ultraviolet radiation at the coating surface per square meter per day, hereinafter $\mu$mol/W $m^2$ day, where the higher the value indicates a greater photoelectrolytic activity. There is no absolute rate which renders a PED coating "acceptable" or "unacceptable" because whether the PED coating has an acceptable level of PED activity is largely determined by the performance standards selected for the multiple-glazed window unit as noted above. Generally, the PED reaction rate is desired to be as high as possible. Preferably, the PED reaction rate is at least about 0.1 $\mu$mol/W $m^2$ day, more preferably, the PED reaction rate is at least about 1.0 $\mu$mol/W $m^2$ day.

The ability of the PASC coating to remove organic contaminants associated with the PASC coating is referred to as the PASC reaction rate. The PASC reaction rate may be reported in the units of reciprocal centimeters, reciprocal minutes ("$cm^{-1}$ $min^{-1}$"), where the higher the value indicates a greater PASC activity. There is no absolute rate which renders a PASC coating "acceptable" or "unacceptable" because whether the PASC coating has an acceptable level of PASC activity is largely determined by the performance standards selected for the insulated window unit as noted above. Generally, the PASC reaction rate is desired to be as high as possible. Preferably, the PASC reaction rate is at least about $2\times10^{-3}$ $cm^{-1}$ $min^{-1}$. More preferably, the PASC reaction rate is at least about $5\times10^{-3}$ $cm^{-1}$ $min^{-1}$.

While the thickness of the SIDB layer necessary to prevent sodium ion poisoning of the PASC coating will vary with several factors, including the chemistry of the SIDB layer, the time period and temperature at which a substrate will be maintained, the nature of the substrate and rate of sodium ion migration from the substrate, the thickness of the PED coating or PASC coating, and the degree of photoelectrolytic-desiccation or photocatalytically-activated self-cleaning activity required for a given application, typically for most applications, the SIDB layer thickness should be at least about 100 Å, preferably at least about 250 Å and more preferably at least about 500 Å thick to prevent sodium ion poisoning of the PED coatings and/or PASC coatings deposited thereover for most sodium ion containing substrates.

PED coatings, hydrophilic coatings, PASC coating and/or SIDB layers compatible with the present invention may each be formed on the various surfaces of the multiple-glazed window unit of the present invention in any convenient manner including by the sol-gel process, by the spray pyrolysis process, by the chemical vapor deposition process (hereinafter "CVD") or by the magnetron sputtering vacuum deposition process (hereinafter "MSVD"). Forming a PASC coating and/or an SIDB layer by these methods have been described in detail U.S. Provisional Patent Application Ser. No. 60/040,566 filed Mar. 14, 1997, and U.S. Regular patent application Ser. No. 08/899,265 filed Jul. 23, 1997, in the name of Charles B. Greenberg et al., entitled Photocatalytically-Activated Self-Cleaning Article and Method of Making Same, both of which have been incorporated by reference hereinabove. In addition, U.S. patent application Ser. No. 08/597,543 filed Feb. 1, 1996, entitled "Alkali Metal Diffusion Barrier Layer", incorporated herein by reference, discloses the formation of alkali metal diffusion barriers by magnetron sputtering. The barrier layer is taught therein to be generally effective at thicknesses of about 20 Å to about 180 Å, with effectiveness increasing as the density of the barrier increases.

The PED, PASC, hydrophilic and/or SIDB coatings may be applied to multi-glazed window unit components after manufacture of the components but before assembly into the unit or applied to one or more of the components during manufacture of the components or any combination thereof.

The PED and PASC coatings incorporated in the multiple-glazed window unit of the present invention are activated to be photoelectrolytically-desiccating or photocatalytically self-cleaning upon exposure to radiation of the appropriate wavelength and of the proper intensity for a sufficient interval of time. Where PED or PASC activity is induced by ultraviolet radiation, the source of the ultraviolet radiation may be natural (i.e., solar) or artificial. Artificial radiation has an advantage in that its intensity and intervals of irradiation are more easily controlled. Artificial radiation is also advantageous in that it is commonly provided by existing lighting in today's buildings, e.g. fluorescent lighting.

Where the PED coating or PASC coating is a titanium dioxide coating, the radiation which will activate desiccating or self-cleaning activity is ultraviolet radiation having a wavelength in the range of about 300 to 400 nanometers (hereinafter "nm").

In addition to fluorescent lighting described above, artificial ultraviolet radiation sources also include a black light source. An alternative light source is available from the Q-Panel Company of Cleveland, Ohio, under the model designation "UVA-340". From whatever the source, solar or artificial, the intensity of ultraviolet radiation striking the PED coating and/or PASC coating is preferably sufficiently intense so as to obtain a desired PED or PASC activity. Intensities within the range of 5 to 100 watts per square meter (hereinafter "W/$m^2$") preferably of at least about 10 W/$m^2$ and more preferably of at least about 20 W/$m^2$ calibrated at the coating surface are desired. The intensity may be calibrated for example with an ultraviolet meter such as that sold under the trademark BLACK-RAY® by Ultraviolet Products, Inc., of San Gabriel, Calif., under the model designation J-221.

The duration and intensity for which the source of ultraviolet radiation must be directed over the PED coating and/or PASC coating depends on a number of factors, including the type of surface on which the PED coating and/or PASC coating is applied, the thickness of the PED coating and/or PASC coating, the rate of accumulation of moisture or organic contaminants accumulated on the PED coating and/or PASC coating, the incident angle of the ultraviolet radiation on the PED coating and/or PASC coating, the intensity of the source of ultraviolet radiation at the PED coating and/or PASC coating surface, the PED coating and/or PASC reaction rate desired or required, the degree to which the ultraviolet radiation may be reflected or absorbed by the substrate and/or any other coatings or layers present thereon. Therefore, it is not possible to generally prescribe a set time period or intensity for which the ultraviolet radiation source must be directed over the PED coating and/or PASC coating to obtain a desired or required level of desiccation or self-cleaning, as may be appreciated. However, for many applications, the source of ultraviolet radiation is preferably directed over the PED coating and/or PASC coating for at least about 1 to 15 hours each day at an intensity of at least about 20 $W/m^2$ at the surface of the PED coating and/or PASC coating to ensure that the bulk of the moisture and/or organic contaminants accumulated on the PED coating and/or PASC coating are removed.

Where the multiple-glazed window unit includes a desiccant, the desiccant should be capable of absorbing from the atmosphere in excess of 5 to 10 percent of its weight, preferably in excess of 10 percent of its weight, in moisture. However, the type of desiccant is not limiting to the invention and may be any of the types used in the art. In order to function effectively, the desiccant material should have at least a minimum level of communication with the airspace, so that moisture not photoelectrolytically desiccated will be effectively adsorbed by the desiccant material.

The present invention provides several advantages over presently available multiple-glazed window units. One advantage is that the multiple-glazed window unit of the present invention does not rely on the limited lifetime desiccant to provide a moisture-free airspace. While a desiccant may be included to compliment of the activity of the PED coating provided on surfaces contacting the airspace, such a desiccant is optional.

Another advantage of the multiple-glazed window unit of the present invention is that through photocatalytically-activated self cleaning, it is able to remove organic surface contaminants which have accumulated over surfaces of the insulated window unit having the PASC coating thereon. This is of particular advantage for removing accumulated surface contaminants from interior surfaces of the unit contacting the airspace, which have heretofore been impossible to clean without complete disassembly of the unit.

Although the present invention has been described in some detail with regard to some embodiments thereof, it should be clearly understood that the present invention is not limited thereto, and that many variations and/or modifications may appear to those in the art without departing from the spirit and scope of the invention. The scope of the present invention is defined by the following claims.

What is claimed is:

1. A multiple-glazed window unit having at least two sheets and a means to space said sheets from one another to provide an airspace between the sheets, the improvement comprising:

a photoelectrolytically-desiccating coating over at least a portion of at least one surface of the unit exposed to the airspace and subject to the accumulation of moisture present in the airspace thereon, whereupon said photoelectrolytically-desiccating coating promotes the photoelectrolysis of said accumulated moisture into hydrogen gas and oxygen gas.

2. The unit as set forth in claim 1 wherein the improvement further comprises:

at least one hydrophilic coating associated with said photoelectrolytically-desiccating coating to increase contact between said moisture present in the airspace and the photoelectrolytically-desiccating coating.

3. The unit as set forth in claim 1 wherein the improvement further comprises:

a photocatalytically-activated self-cleaning coating over at least a portion of at least one surface of the unit exposed to the airspace subject to the accumulation of organic surface contaminants present in the airspace thereon, whereupon said photocatalytically-activated self-cleaning coating promotes the photocatalytic decomposition of said organic surface contaminants into carbon dioxide and water vapor.

4. The unit as set forth in claim 3 wherein at least one of said surfaces having a coating deposited thereover selected from the group consisting of said photoelectrolytically-desiccating coating and said photocatalytically-activated self-cleaning coating is subject to the migration of ions from said surface into said coatings deposited over said surface, the improvement further comprising:

an ion diffusion barrier interposed between said surface and said coatings to prevent ion poisoning of at least one of said coatings.

5. The unit of claim 4 wherein said ion are sodium ions and said ion diffusion barrier is a sodium ion diffusion barrier.

6. The unit of claim 3 wherein said photoelectrolytically-desiccating coating and said photocatalytically-activated self-cleaning coating are deposited over said surface as a single homogeneous coating.

7. The unit of claim 3 wherein said photoelectrolytically-desiccating coating and said photocatalytically-activated self-cleaning coating are deposited over said surface as a single heterogeneous coating.

8. The unit as set forth in claim 1 wherein said unit does not include a desiccant in fluid communication with said airspace.

9. The unit as set forth in claim 1 further comprising a desiccant in fluid communication with said airspace.

10. The unit as set forth in claim 3 further comprising a desiccant in fluid communication with said airspace.

11. The unit as set forth in claim 3 wherein said photoelectrolytically-desiccating coating and said photocatalytically-activated self-cleaning coating are each respectively a metal oxide selected from the group consisting of titanium oxides, iron oxides, silver oxides, copper oxides, tungsten oxides, aluminum oxides, silicon oxides, zinc oxides, zinc stannates, molybdenum oxides, strontium titanate and mixtures thereof.

12. The unit as set forth in claim 11 wherein said metal oxide is a titanium oxide selected from the group consisting of anatase titanium dioxide, rutile titanium dioxide, brookite titanium dioxide and mixtures thereof.

13. The unit as set forth in claim 2 wherein said hydrophilic coating is selected from the group consisting of alumina, silica, aluminates, silicates, aluminosilicates and mixtures thereof.

14. The unit as set forth in claim 4 wherein said ion diffusion barrier is a metal oxide selected from the group consisting of cobalt oxides, chromium oxides, iron oxides, tin oxides, silicon oxides, titanium oxides, zirconium oxides, fluorine doped tin oxides, aluminum oxides, magnesium oxides, zinc oxides, magnesium/aluminum oxides, zinc/tin oxides and mixtures thereof.

15. The unit as set forth in claim 3 wherein said photoelectrolytically-desiccating coating and said photocatalytically-activated self-cleaning coating are each within the range of about 200 to 5000 Angstroms thick.

16. The unit as set forth in claim 2 wherein said hydrophilic coating is within the range of about 5 to 5000 Angstroms thick.

17. The unit as set forth in claim 4 wherein said ion diffusion barrier layer is at least about 100 Angstroms thick.

18. The unit as set forth in claim 1 wherein said photoelectrolytically-desiccating coating has a desiccating activity of at least about 0.1 $\mu$mol/W $m^2$ day.

19. The unit as set forth in claim 3 wherein said self-cleaning coating has a photocatalytically-activated self-cleaning activity reaction rate of at least about $2\times10^{-3}$ $cm^{-1}$ $min^{-1}$.

20. The unit as set forth in claim 1 wherein at least one surface of said sheets further comprises at least one coating selected from the group consisting of antireflective coatings, antiglare coatings, antifogging coatings, deicing coatings, defrosting coatings, ultraviolet radiation-filtering coatings, emissivity filtering coatings, tinting coatings, shading coatings and mixtures thereof.

21. The unit as set forth in claim 1 wherein said unit further comprises a photocatalytically-activated self-cleaning coating deposited over a surface of said unit which is not in contact with said airspace to remove surface contaminants accumulating over said photocatalytically-activated self-cleaning coating.

22. The unit as set forth in claim 21 wherein said surface is an exterior surface of at least one of said sheets.

23. The unit as set forth in claim 22 further comprising an ion diffusion barrier layer interposed between said exterior surface and said photocatalytically-activated self-cleaning coating to prevent ion poisoning of said photocatalytically-activated self-cleaning coating.

24. A multiple-glazed window unit having at least two sheets and a means to space said sheets from one another to provide an airspace between the sheets, the improvement comprising:

a) a photoelectrolytically-desiccating coating deposited over at least a portion of a first surface of the unit exposed to the airspace and subject to the accumulation of moisture present in the airspace thereon, whereupon said photoelectrolytically-desiccating coating promotes the photoelectrolysis of said accumulated moisture from said first surface primarily into hydrogen gas and oxygen gas;

b) at least one hydrophilic coating associated with said photoelectrolytically-desiccating coating to increase contact between said moisture present in the airspace and the photoelectrolytically-desiccating coating;

c) a photocatalytically-activated self-cleaning coating over at least a portion of a second surface of the unit exposed to the airspace and subject to the accumulation of organic surface contaminants present in the airspace thereon whereupon said photocatalytically-activated self-cleaning coating promotes the photocatalytic decomposition of said organic surface contaminants primarily into carbon dioxide and water vapor, wherein said first surface and said second surface may be the same or a different surface; and d) a sodium ion diffusion barrier layer interposed between a source of sodium ions and a coating selected from the group consisting of said photoelectrolytically-desiccating coating and said photocatalytically-activated self-cleaning coating to prevent sodium ion poisoning of said coating.

25. The unit of claim 24 wherein said photoelectrolytically-desiccating coating and said photocatalytically-activated self-cleaning coating are each deposited as a single homogeneous coating over a surface selected from the group consisting of said first surface said second surface.

26. The unit of claim 24 wherein said photoelectrolytically-desiccating coating and said photocatalytically-activated self-cleaning coating are deposited together in a single heterogeneous coating over a surface selected from the group consisting of said first and said second surface.

27. The unit of claim 24 wherein said airspace contains a material selected from the group consisting of air, argon, nitrogen, krypton and mixtures thereof.

28. The unit of claim 1 wherein said airspace contains a material selected from the group consisting of air, argon, nitrogen, krypton and mixtures thereof.

* * * * *